United States Patent [19]

Burroughs

[11] 4,452,167

[45] Jun. 5, 1984

[54] FLAG MOUNTING DEVICE

[76] Inventor: W. Stanley Burroughs, 3825 N. Wakefield St., Arlington, Va. 22207

[21] Appl. No.: 346,911

[22] Filed: Feb. 8, 1982

[51] Int. Cl.[3] ..... G09F 17/00

[52] U.S. Cl. ..... 116/173; 116/174

[58] Field of Search ..... 116/173, 174; 52/570, 52/720; 254/134.3 CL

[56] References Cited

U.S. PATENT DOCUMENTS

| | | | |
|---|---|---|---|
| 2,672,118 | 3/1954 | Martin | 116/174 |
| 3,595,202 | 7/1971 | Visitacion | 116/174 |

FOREIGN PATENT DOCUMENTS

| | | | |
|---|---|---|---|
| 63529 | 1/1892 | Fed. Rep. of Germany | 116/174 |
| 435017 | 2/1912 | France | 116/173 |

*Primary Examiner*—S. Clement Swisher
*Assistant Examiner*—Hezron Williams
*Attorney, Agent, or Firm*—Stanley C. Spooner

[57] ABSTRACT

A device for preventing a flag from wrapping around a flagpole, especially one which is inclined at an angle with the vertical. The flag is mounted along one edge to a support member which in turn is pivotally mounted for rotation about the flagpole. A semi-flexible rod is sewn into the hem along a lower edge of the flag. This semi-flexible rod is pivotally attached to the support member such that it can pivot from a position perpendicular to the support member to a position essentially parallel with the support member. Thus, the flag can be stored by folding the semi-flexible rod parallel with the support member and the material of the flag wrapped around the support member and/or the flagpole. When not in storage, the semi-flexible rod extends the lower portion of the flag outward from the flagpole effectively preventing the flag from wrapping back around the flagpole and becoming entangled.

2 Claims, 3 Drawing Figures

18
14
12
36
34
24
38
26
28
32
30
22

18
14
12
22
24
26
38
34

FLAG MOUNTING DEVICE

The present invention relates generally to devices for mounting flags on a flagpole and specifically to preventing a flag from wrapping around a flagpole.

It is well known that flags, when blown by variable gusty winds, will occasionally wrap themselves around the flagpole to which they are mounted. Thus entangled, the flag cannot be unfurled by the next breeze and is thus rendered relatively useless. This problem is particularly acute with flagpoles which extend at an approximately 45 degree angle with the vertical. When the flag in this instance has been picked up and tossed over the shaft, the weight of the flag material on both sides of the staff effectively prevents the wind from untangling the flag, thus requiring the owner to manually untangle the flag in order for it to operate properly in subsequent breezes.

In the past, rigid extensions along the upper edge of the flag have been used to maintain the flag in a partially extended state, tensioning the flag material such that only a small amount of material can be whipped back and become entangled with the flagpole itself. While this has been partially successful, such a device is not aesthetically pleasing because unless a very strong breeze is blowing the flag appears to be artificially extended, thus detracting from the visual impact of the flag.

SUMMARY OF THE INVENTION

Therefore, in view of the above, it is an object of the present invention to provide a device which will minimize the possibility of a flag becoming entangled with a flagpole while at the same time maintaining a natural appearance of the flag.

It is a further object of the present invention to provide a flag mounting device that maintains the natural appearance of the flag and yet is easily collapsed for folding the flag into a convenient package. The above and other objects are achieved by providing a support member to which the flag is attached and which is itself pivotally attached to the flagpole. Among at least a portion of the lower edge of the flag, a semi-flexible rod is attached with one end pivotally connected to the support member such that the semi-flexible rod can be pivoted to lie adjacent the support member. Additionally, a device is provided which will hold the semi-flexible rod in a position such that it extends perpendicular to the support member. When the semi-flexible rod is equal to or less than the vertical dimension of the flag and the flagpole is mounted at a 45-degree angle, the flag will hang in almost a completely natural state and yet the support member in combination with the semi-flexible rod, will prevent the flag's entanglement with the flagpole even in extremely variable and/or gusty wind conditions.

BRIEF DESCRIPTION OF THE DRAWINGS

A more complete appreciation of the invention, and many of the attendant advantages thereof, will be readily apparent by reference to the accompanying Drawings, wherein.

DETAILED DESCRIPTION OF THE PREFERRED EMBODIMENTS

Figure 1:
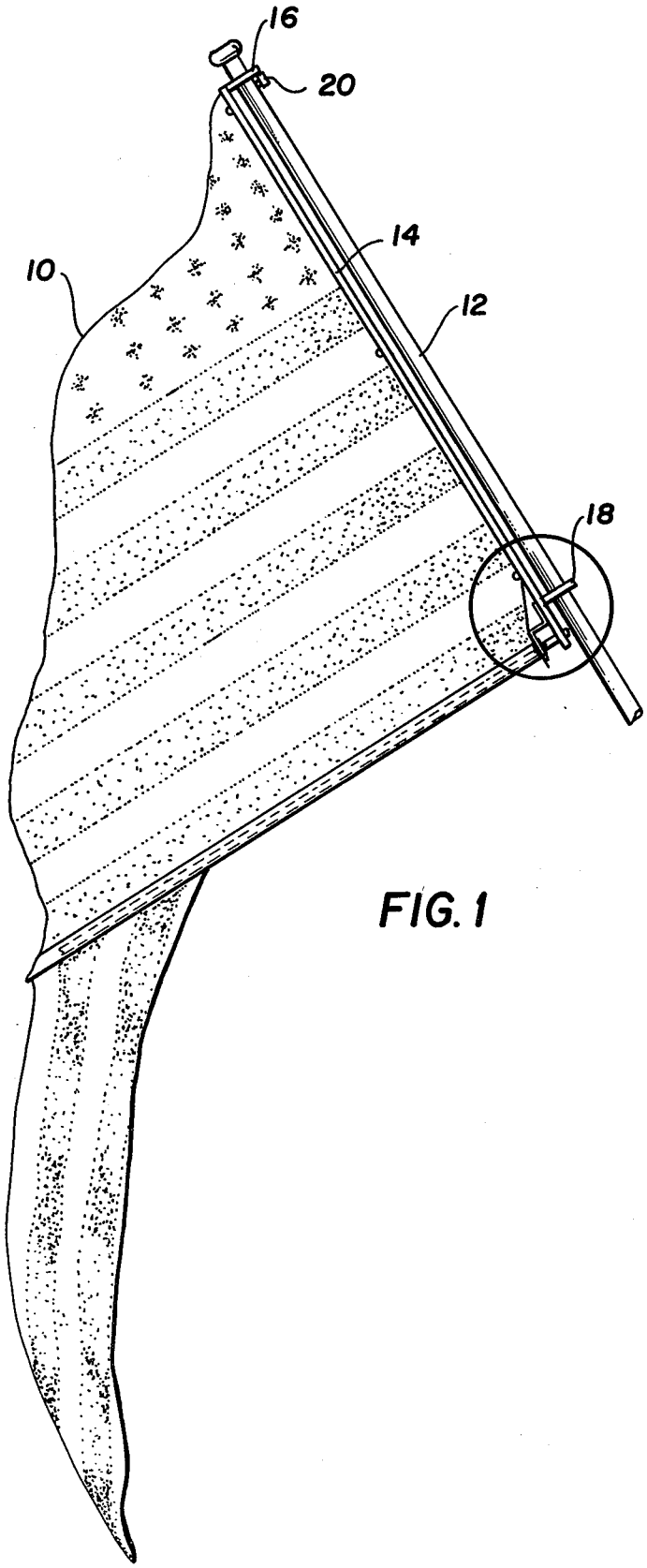
FIG. 1 is a side view of a flag mounted on a flagpole in accordance with the present invention.

Referring now more particularly to the Drawings, wherein like numerals represent like elements throughout the several views, FIG. 1 illustrates a flag 10 in conjunction with a flagpole 12. A support member 14 which may be a lightweight wooden strip, is fixed to the flagpole by means of flanges 16 and 18 which in a preferred embodiment are a hardwood. The flagpole extends through holes in flanges 16 and 18 and thus the support member 14 is free to rotate around the longitudinal axis of the flagpole.

The right-hand hem of the flag, as shown in FIG. 1, is securely attached to support member 14 by any convenient attachment method, in one embodiment by means of machine screw/washer/nut combinations. A projection 20 prevents flange 16 from sliding down the flagpole while permitting the support member to rotate about the longitudinal axis of the flagpole. In a preferred embodiment, projection 20 is a machine screw threadably received into the flagpole 12.

Figure 2:
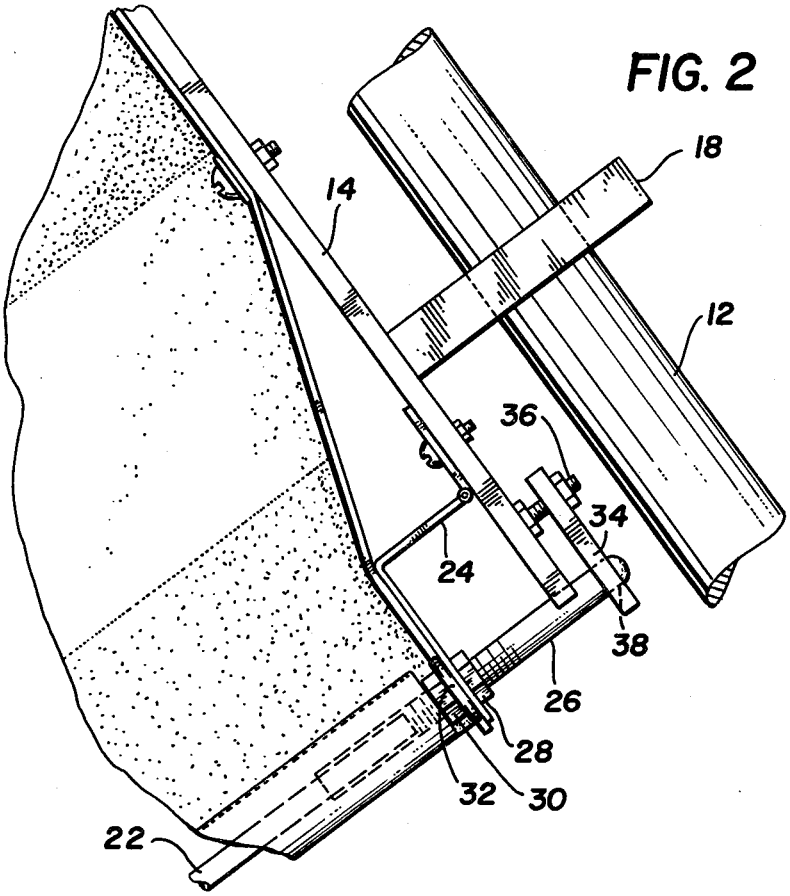
FIG. 2 is an enlarged side view of the circled portion of FIG. 1 with the flag in the normal mode.

FIG. 2 shows in detail the pivoting mechanism of FIG. 1 which connects the support member 14 to semi-flexible rod 22. Although any pivoting mechanism could be utilized which permits rod 22 to pivot in the vertical direction only with respect to support member 14, in the preferred embodiment hinge 24 is secured to support member 14 by means of a machine screw/washer/nut combination and to threaded rod 26 by means of nuts 28 and 30. The semi-flexible rod 22 is a press fit into a suitable aperture in one end of threaded rod 26. In a preferred embodiment, a grommet 32 at the lower portion of the flag is retained by nuts 28 and 30 along with one portion of hinge 24. It can be seen that when semi-flexible rod 22 is pivotally moved around the pivot point of hinge 24, it will lie essentially parallel to support member 14 as shown in FIG. 3 permitting the flag to be wrapped around the semi-flexible rod, the support member and flagpole 12 for storage purposes.

The semi-flexible nature of rod 22 gives the flag a relatively natural appearance as it will flutter to a small extent in any breeze in which the flag is fluttering. A suitable material is an aluminum rod approximately ⅛ of an inch in diameter with the threaded rod being about ¼ of an inch in diameter. Because the fabric of the flag itself will not permit the angle between the semi-flexible rod and the support member to become greater than 90 degrees, the lower edge of the flag is maintained a substantial distance away from the flagpole 12. In a gusty wind condition, this distance is generally enough to prevent the flag from whipping back against and entangling with the flagpole. However, in an upward gust, unless the semi-flexible rod is restrained against upward pivotal movement, it is possible for the flag to be blown upward and around the upper portion of the flagpole, possible causing an entanglement. In order to prevent this difficulty, a means for maintaining the semi-flexible rod perpendicular to the support member 14 is provided. In a preferred embodiment, a latch plate 34 is affixed to support member 14 by means of a machine screw/washer/nut combination 36. An aperture 38 in latch plate 34 permits the latch plate to be pulled over the extended portion of threaded rod 26 which then prevents the threaded rod and semi-flexible rod 22 from pivotally moving around the pivot point of hinge 24 maintaining the rod at essentially a 90-degree angle with respect to support member 14.

In view of the above disclosure, it will be apparent to one skilled in the art that there are numerous structures which can achieve the function desired by the above structural interconnections. For example, the semi-flexible rod could be directly pivotally attached to the support member 14 with a suitable wedge to prevent undesired lifting of the rod when in use. Just as obviously, it may not be necessary to have support member 14 connecting flanges 16 and 18 as long as some means is provided to pivotally connect the edge of the flag to the flagpole while permitting complete freedom of movement around the flagpole. For example, flange 18 could be a cylindrical segment surrounding the flagpole 12 and connected directly to the edge of the flag. The semi-flexible rod could be pivotally connected directly to the cylinder with a brace removably connecting another portion of the rod with the cylinder so as to maintain the rod in the perpendicular position in the same manner as the latch plate 34.

Figure 3:
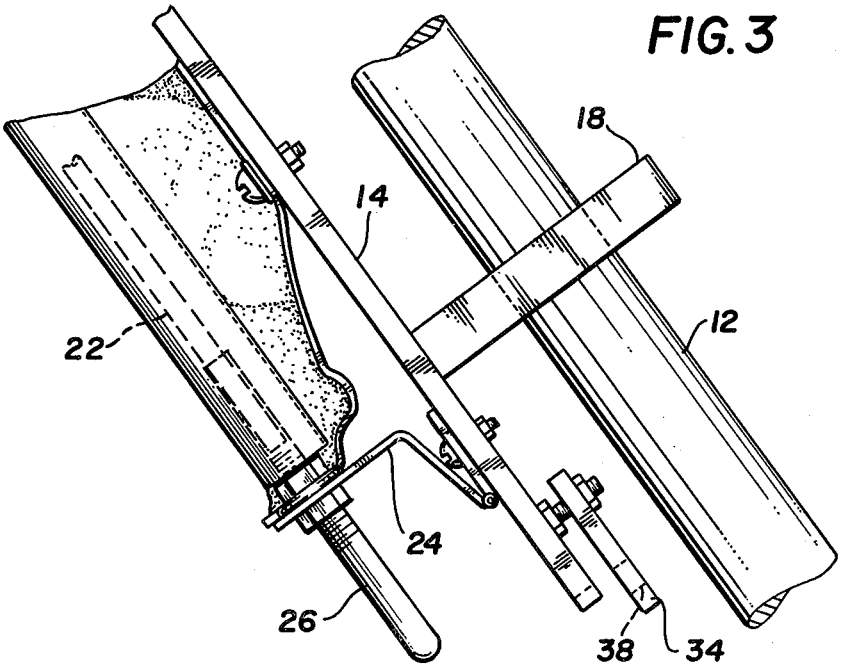
FIG. 3 is a side view of the pivoting mechanism shown in FIG. 2, but in the furled or stored configuration.

Therefore, in view of the above teachings, modification of the structures disclosed in FIG. 1 through 3 will become obvious to those of ordinary skill in the art and the invention described hereinbefore is limited only in accordance with the appended claims.

The embodiments of the invention in which an exclusive property or privilege is claimed are defined as follows:

1. An apparatus for mounting a flag on a flagpole to prevent twisting of the flag around the pole, said apparatus comprising:

a support member connected to one side of said flag;

means for mounting said support member on said flagpole and permitting rotation of the support member around said flagpole;

semi-flexible rod means mounted on a lower edge of said flag for maintaining at least a portion of said lower edge in a substantially straight line;

hinge means for pivotally mounting said semi-flexible rod means on a lower portion of said support member, said hinge means comprising means for permitting movement of said semi-flexible rod means relative to said support member only in a plane including said flagpole and said support member; and latch means for detachably maintaining said semi-flexible rod means in a position substantially perpendicular to said support member.

2. An apparatus for mounting a flag on a flagpole to prevent twisting of the flag around the pole, said apparatus comprising:

a support member connected to a first side of said flag and parallel to said flagpole;

means for mounting said support member on said flagpole for rotation about said flagpole while remaining parallel therewith;

semi-flexible rod means, mounted along a second side of said flag adjacent said first side, for maintaining at least a portion of said second side in a substantially straight line; and hinge means for pivotally mounting said semi-flexible rod means to said support member, said hinge means including means for permitting movement of said semi-flexible rod means relative to said support member only in the plane including said flagpole and said support member.

* * * * *